US005797233A

United States Patent [19]

Hascall

[11] Patent Number: 5,797,233

[45] Date of Patent: Aug. 25, 1998

[54] PRE-SPACED TIME-SAVING TRACK FOR MOUNTING STUDS FOR CONSTRUCTION OF DRYWALL AND OTHER WALL SURFACES

[76] Inventor: Karl B. Hascall, 2833 - 72nd St., SW., Byron Center, Mich. 49315

[21] Appl. No.: 777,151

[22] Filed: Dec. 26, 1996

Related U.S. Application Data

[60] Provisional application No. 60/009,873 Dec. 29, 1995.

[51] Int. Cl.[6] ..... E04C 3/07

[52] U.S. Cl. ..... 52/481.1; 52/482; 52/489.1; 52/653.1; 52/656.9; 52/731.7; 52/731.8; 52/731.9; 52/733.3; 52/736.2; 52/737.6

[58] Field of Search ..... 52/481.1, 489.1, 52/482, 653.1, 656.9, 731.7, 731.8, 731.9, 733.3, 736.2, 737.6

[56] References Cited

U.S. PATENT DOCUMENTS

| | | | |
|---|---|---|---|
| 1,198,031 | 9/1916 | Henderson . | |
| 1,814,202 | 7/1931 | Winget . | |
| 2,275,109 | 3/1942 | McGee . | |
| 3,270,472 | 9/1966 | Gilbert | 52/481.1 X |
| 3,536,345 | 10/1970 | Leifer . | |
| 3,999,875 | 12/1976 | Simon . | |
| 4,312,158 | 1/1982 | Teli et al. . | |
| 4,805,364 | 2/1989 | Smolik . | |
| 4,854,096 | 8/1989 | Smolik . | |
| 5,222,335 | 6/1993 | Petrecca . | |
| 5,394,665 | 3/1995 | Johnson | 52/481.1 X |

FOREIGN PATENT DOCUMENTS

| | | |
|---|---|---|
| 3504548 | 8/1986 | Germany . |

OTHER PUBLICATIONS

Advertising flier for FasLok Framing System by Custom Building Systems Corporation, Muskogee, Oklahoma.

*Primary Examiner*—Christopher Kent
*Attorney, Agent, or Firm*—Rader, Fishman, Grauer & McGarry

[57] ABSTRACT

A track assembly includes a track on which several studs may be quickly fastened at predetermined intervals. The studs include a standard C-shaped member having inwardly-directed lips located on a pair of transverse walls thereon. The track assembly is provided with several tabs which can be bent around the lips of each stud in order to mount the stud to the track and restrict movement of the stud in first and second directions with respect to the track.

22 Claims, 1 Drawing Sheet

PRE-SPACED TIME-SAVING TRACK FOR MOUNTING STUDS FOR CONSTRUCTION OF DRYWALL AND OTHER WALL SURFACES

CLAIM OF PRIORITY

The application claims priority pursuant to 35 U.S.C. § 119 of U.S. provisional patent application Ser. No. 60/009,873, filed Dec. 29, 1995.

BACKGROUND OF THE INVENTION

1. Field of the Invention

This invention relates to a wall stud and track assembly and, more specifically, to a track for mounting studs in a vertical configuration, the track having a means for quickly fastening the studs to the track at predetermined intervals.

2. Description of Related Art

During the construction of a commercial or residential structure, vertically oriented studs are generally mounted in spaced relationship to provide a support structure onto which drywall or another wall surface material can be hung. The studs often include lateral bores through which electrical, plumbing or other conduits can be navigated. The studs can be wood or extruded metal profiles. For a metal wall stud structure, a track is mounted along the floor and ceiling each of which receive one end of the vertically oriented stud. The stud is retained in the track by suitable securing means.

One prior art metal track and stud system is the FasLok Framing System by Custom Building Systems Corporation, 627 Elgin Avenue, P.O. Box 829, Muskogee, Okla., 74402. As shown in FIG. 3 (prior art), a track 10 is shown having a generally U-shaped cross-section which is manufactured having a pair of inwardly-folded tabs 12 on each side of the track 10 forming a pair of inwardly-directed C-shaped flanges 14, 16. The flanges 14 and 16 are mounted in a spaced relationship along the longitudinal length of the track 10. A stud 18 having a generally C-shaped cross section, can be vertically mounted between each set of flanges 14 and 16 by sliding the end of the stud 18 into the rectangular gap defined by the flanges 14 and 16 so that a tab 12 extends a short distance along both the forward and rearward surfaces of the stud 18. Although these prior art mountings are sufficient to retain the studs 18, it is difficult to insert the studs after the tracks have been mounted to the floor and ceiling.

SUMMARY OF THE INVENTION

This invention overcomes the problems of the prior art by providing a wall construction wherein vertical metal wall studs are more easily assembled to horizontal channel shaped tracks to form a framework for mounting drywall construction panels or other wall material in formation of a wall and also accommodates a wide variety of track widths to accommodate several different stud width and gauges which allow the track to be used in various building applications.

In one aspect, the invention relates to a wall construction comprising a plurality of elongated studs each having a pair of opposed sidewalls, said sidewalls each having an inwardly-directed lip thereon. First and second elongate members are provided which each have a longitudinal axis and are formed of a resiliently deformable material which each comprise an elongate base wall, first and second opposed side walls extending generally perpendicular from the base wall. The base wall and side walls define a channel therein. The first and second side walls each have at least one tab which is deformed around one of the lips of the stud when the stud is perpendicular to either the first or second elongate members.

The base wall of at least one of the first and second elongate members preferably further comprises a longitudinal protrusion to provide additional structural support to the elongate member. The tab can be defined by a vertical edge and a horizontal edge whereby the vertical edge extends downwardly from a terminal edge of one of the sidewalls and the horizontal edge extends longitudinally from the vertical edge. A means for starting a fastener through one of the side walls of the elongate member and through a transverse wall of the stud is also provided. The lip on the sidewalls of the stud typically have a first face and a second face. The tab preferably further comprises a first portion and a second portion whereby the first portion is adjacent the first face and the second portion is adjacent the second face when the tab is bent around the lip. The tab can be one of a plurality of similar tabs spaced along each side wall of the elongate member at regular intervals. The regular interval is preferably selected from the group consisting of: six inches, eight inches, sixteen inches and twenty-four inches.

In another aspect, the invention relates to a wall construction track for receipt of an end of an elongated stud. The stud typically has a pair of opposed sidewalls, the sidewalls each having an inwardly-directed lip thereon and each lip has a terminal end. The wall construction track comprises an elongate member formed of bendable material having a base wall and first and second side walls extending perpendicularly from the base wall which cooperate to form a channel therein. The first and second side walls each have at least one tab which is bendable about an axis. The tab is preferably of a sufficient length to be bent about the axis around the terminal end of the lip of a stud when the stud is disposed in a generally perpendicular relationship with respect to the elongate member.

The base wall of the elongate member can preferably further comprise at least one longitudinal protrusion to provide additional structural support to said elongate member. The tab can be defined by a vertical edge and a horizontal edge whereby the vertical edge extends downwardly from a distal edge and the horizontal edge extends longitudinally from the vertical edge. The wall construction track can further include a means for starting a fastener through one of the side walls of the elongate members and through a transverse wall of the stud. In one embodiment, the lip on each sidewall of the stud has a first face and a second face and the tab further comprises a first portion and a second portion whereby the first portion is adapted to be adjacent the first face and the second portion is adapted to be adjacent the second face.

In an additional aspect, the invention relates to a method of wall construction comprising the steps of providing a plurality of elongated studs, each of which has a pair of opposed side walls, each of the side walls having an inwardly-directed lip thereon; providing an elongate member having a base and first and second side walls extending perpendicularly from the base, each of the first and second side walls having at least one tab, the tab being bendable about an axis; assembling a stud to the elongate member by placing one end of the wall stud into the channel of the elongate member so that the lips of the stud are disposed adjacent a rearward portion of the tab; and confining the end of the wall stud in said elongate member by bending the tab inwardly around the lips of the stud.

The method of wall construction claimed herein can further include some or all of the steps of: providing the base wall of the elongate member with at least one longitudinal protrusion to provide additional structural support to said elongate member, providing the elongate member with means for starting a fastener through one of its side walls and through a transverse wall of the stud; and spacing the tab among a plurality of similar tabs along each side wall of the elongate member at regular intervals.

In a further aspect, the invention also relates to a wall construction for receipt of an end of an elongated stud, the stud having a pair of opposed sidewalls, the sidewalls each having an inwardly-directed lip thereon. The wall construction track comprises an elongate member formed of bendable material having a base wall and first and second side walls extending perpendicularly from the base wall which cooperate to form a channel. The first and second side walls each have at least one tab which is bendable about an axis. The tab has a first portion and a second portion which are of a sufficient length to be bent about the axis around the lip of a stud when the stud is disposed in a generally perpendicular relationship with respect to the elongate member. The first portion projects inwardly from a respective first and second side wall and the second portion is bent relative to the first portion.

BRIEF DESCRIPTION OF THE DRAWINGS

The invention will now be described with reference to the drawings wherein.

DESCRIPTION OF THE PREFERRED EMBODIMENTS

Figure 1:
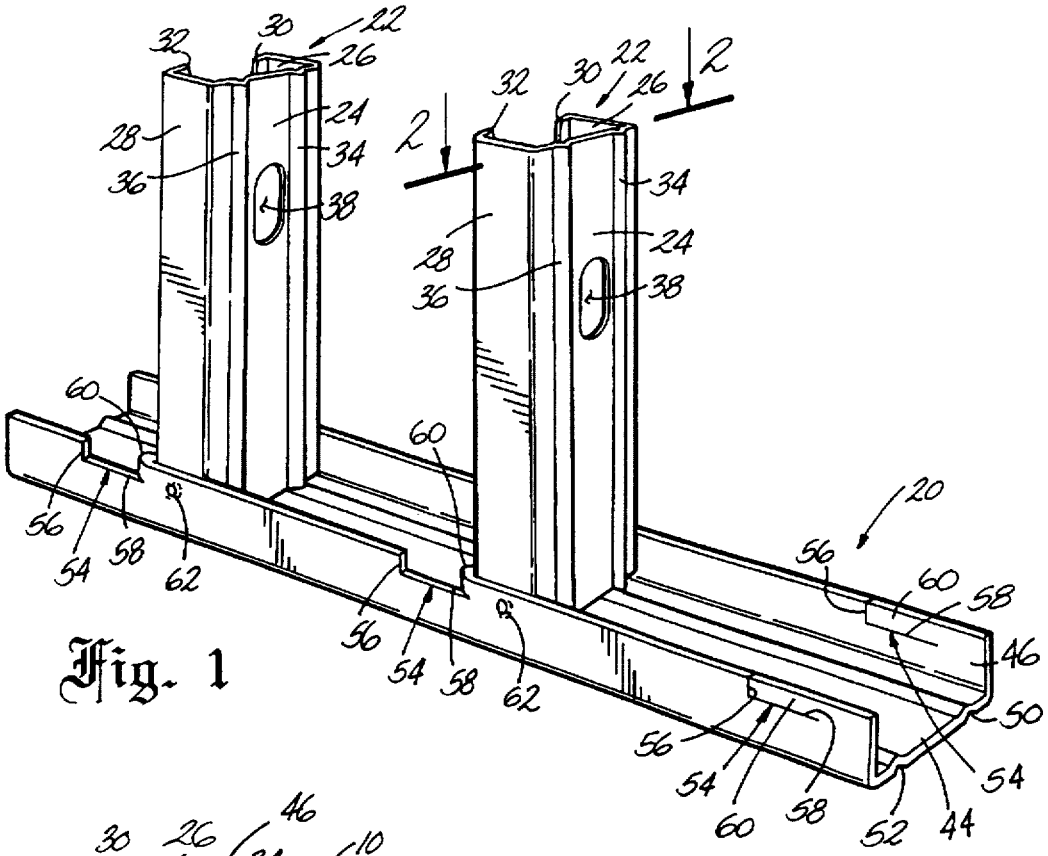
FIG. 1 is a perspective view of a portion of a fast-locking steel stud track system according to the invention.
Figure 2:
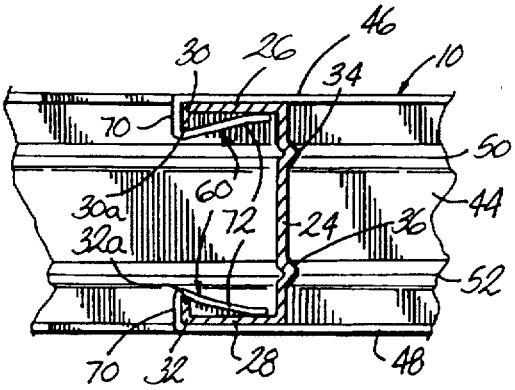
FIG. 2 is a cross-sectional view of the steel stud system taken along lines 2—2 of FIG. 1.
Figure 3:
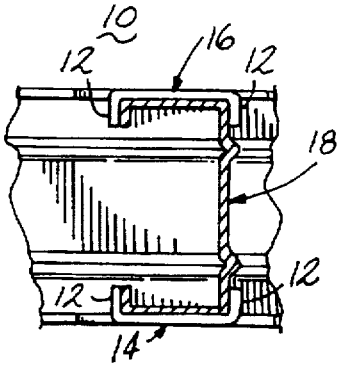
Fig. 3 (Prior Art)
FIG. 3 is a cross-sectional view similar to FIG. 2 of a prior art steel stud system.

Referring now to the drawings and to FIGS. 1–2 in particular, a track 20 is shown which receives one end of a plurality of studs 22. The track 20 is preferably constructed from steel in the approximate range of 25 gauge to 12 gauge but can be formed from any other suitable material which is sufficiently rigid and retains its shape when deformed. The track 20 can be manufactured in any desired width to receive a wide variety of studs 22, preferably including a range of industry standard widths from 1 to 15 inches in 1/16—inch increments. The stud 22 comprises a typical longitudinal member having a C-shaped cross section as defined by transverse wall 24, lateral walls 26 and 28 and a pair of inwardly-directed lips 30 and 32 provided at the distal edges of the lateral walls 26, 28. Each of the lips 30 and 32 has a terminal end 30*a* and 32*a*, respectively, as shown in FIG.2. Preferably, the studs 22 include a pair of spaced longitudinal triangular projections or ribs 34 and 36 which extend the length of the stud to provide additional structural support. Further, the studs can include one or more apertures 38 in the transverse wall 24 for receiving electrical or plumbing conduits. The invention is further directed to a method and apparatus for quickly mounting the studs 22 in a perpendicular relationship to the track 20 which is anchored at the floor and ceiling along a wall onto which drywall or another suitable finishing surface is to be placed.

The track 20 comprises a longitudinal member having a generally U-shaped cross section defined by a base wall 44 and a pair of opposed upwardly-extending walls 46 and 48. The track 20 can optionally include a pair of longitudinal triangular projections or ribs 50 and 52 which extend upwardly from an interior surface of the base wall 44 to provide additional structural support thereto. The track 20 is provided with a series of L-shaped incisions 54 formed intermittently along each upwardly-extending wall 46 and 48. The L-shaped incisions 54 are defined by a vertical edge 56 extending downwardly from a terminal edge of the upwardly-extending walls 46, 48 and a horizontal edge 58 extending rearwardly from the lowest point of the vertical edge 56. Each L-shaped incision defines a tab 60 which can be bent around a vertical axis adjacent the rearward most point of the horizontal edge 58. Preferably, several tabs 60 are spaced along the upper edge of the upwardly-extending walls 46 and 48 so that each tab 60 on the first upwardly-extending wall 46 has a correspondingly located tab 60 on the upwardly-extending wall 48 as shown in FIG. 1. More preferably, the tabs 60 are spaced at regular intervals along the length of each side wall 46, 48 of the track 20 at industry-standard intervals such as 6, 8, 16 and 24 inches.

The track 20 is prepared for receiving the stud 22 by first cutting the stud 22 to form the vertical edge 56 at the desired locations along the length of each upwardly-extending wall 46 and 48. Next the stud 22 is cut to form the horizontal edge 58 extending from the terminal end of the vertical edge 56 to define the tab 60. The L-shaped incisions 54 can be made at any desired spacing according to customer specifications. Preferably, the spacing of the incisions 54 should be made at gaps of 4 inches or greater to accommodate various stud spacing requirements for a wall structure. The lengths of the vertical and horizontal edges 56 and 58 can be any size which is effective in mounting a stud to the track and which does not detract from the structural strength of the track itself The track 20 can be distributed as is, without prior bending of the tabs 60 in order that several tracks 20 can be stacked within another which provides a space savings during shipping.

In operation, tracks 20 can be positioned along a floor and ceiling adjacent an existing wall onto which a drywall or other finishing surface is to be hung. The tracks 20 can be mounted to the floor or ceiling in any conventional manner such as by threaded fasteners driven through holes (not shown) in the base wall 44 or with adhesives. The studs 22 can be mounted to the tracks 20 as described below before mounting the tracks 20 to the floor and ceiling or a preassembled stud and track assembly can be mounted to the floor and ceiling by conventional methods.

In the preferred assembly method, the tracks 20 are first mounted to the floor and ceiling. Next, a stud 22 is then angularly inserted within the tracks 20 so that one end of the stud 22 rests within the track 20 mounted to the floor and the other end of the stud 22 rests within the track 20 mounted to the ceiling. The stud 22 is then moved into the position shown in FIG. 2 wherein the lateral walls 26 and 28 of the stud 22 abut the upwardly-extending walls 46 and 48 of each track 20 mounted to the floor and ceiling, respectively. Each stud 22 should be located within each track 20 so that the inwardly-directed lips 30 and 32 are disposed adjacent the rearwardmost point of a horizontal edge 58. In order to retain the stud 22 within a track 20 at this desired position, the tabs 60 are bent around the inwardly-directed lips 30 and 32 and can be pressed against the interior surface of the lateral walls 26 and 28 as shown in FIG. 2. Although the bending of the tabs 60 can be accomplished by hand, the tabs 60 can be crimped with a tool against the interior surface of the stud 22 in order to more fully retain the tabs 60 against the lateral walls 26 and 28 of the stud 22. This process can be repeated until an entire wall structure is formed, containing several vertical studs retained within tracks mounted to the floor and ceiling of a room.

It will be understood that the tabs 60 have a first portion 70 and a second portion 72 when the tabs 60 are in the assembled position. The first and second portions 70 and 72 are adapted to be disposed adjacent opposite faces of the lip 30,32. The first portion 70 is generally disposed adjacent the transverse wall 24 of a stud 22. The second portion 72 is disposed in around the lip 30,32 of the stud 22. The second portion 72 can be positioned in any suitable angular position with respect to the first portion 70 including, but not limited to, a perpendicular position, an acute angular position, and a tightly clamped position wherein the second portion 72 contours an interior surface of the stud 22. The first and second portions 70 and 72 of the tab 60 prevent movement of the stud 22 in both a first and a second direction, specifically, in forward and rearward longitudinal positions with respect to the track 20.

It will be further understood that the track 20 can be provided with an inwardly-extending dimple 62 spaced oppositely from each tab 60 so as to correspond in alignment with each lateral wall 28 of a stud 22 mounted therein, as seen in FIG. 1. Each dimple 62 acts as a "starter" so that the dimple 62 can center a fastener to be mounted within the dimple 62 to reinforce the mounting of the stud 22 to the track 20 as desired. In addition, the dimple 62 can also be configured as an aperture (not shown) which extends through the walls 46 and 48 thereof.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments for which an exclusive property or privilege is claimed are defined as follows:

1. A wall construction comprising:

a plurality of elongated studs each having a pair of opposed sidewalls, said sidewalls each having an inwardly-directed lip thereon;

first and second elongate members, each of said elongate members having a longitudinal axis and formed of resiliently deformable material, said elongate members each comprising an elongate base wall, first and second opposed side walls extending generally perpendicular from said base wall, said base wall and side walls defining a channel;

said first and second side walls each having at least one tab;

said at least one tab deformed around one of said lips of said stud when said stud is disposed in a generally perpendicular relationship with respect to one of said first and second elongate members.

2. The wall construction of claim 1 wherein said base wall of at least one of said first and second elongate members further comprises at least one longitudinal protrusion to provide additional structural support to said at least one of said elongate members.

3. The wall construction of claim 1 wherein said at least one tab is defined by a vertical edge and a horizontal edge, said vertical edge extending downwardly from a terminal edge of one of said sidewalls and said horizontal edge extending longitudinally from said vertical edge.

4. The wall construction of claim 1 and further comprising a means for starting a fastener through one of said side walls of said elongate members and through a transverse wall of said stud.

5. The wall construction of claim 1 wherein:

said lip on each sidewall of said stud has a first face and a second face;

said at least one tab further comprises a first portion and a second portion;

whereby said first portion is adjacent said first face and said second portion is adjacent said second face when said tab is bent around said lip.

6. The wall construction of claim 1 wherein said at least one tab comprises a plurality of tabs spaced along each side wall of said elongate member at a regular interval.

7. The wall construction of claim 6 wherein said regular interval is selected from the group consisting of: six inches, eight inches, sixteen inches and twenty-four inches.

8. A wall construction track for receipt of an end of an elongated stud, the stud having a pair of opposed sidewalls, the sidewalls each having an inwardly directed lip thereon, said lip having a terminal end, said wall construction track comprising:

an elongate member formed of bendable material having a base wall and first and second side walls extending perpendicularly from said base wall forming a channel;

said first and second side walls each having at least one tab, said at least one tab being bendable about an axis;

said at least one tab being of a sufficient length to be bent about said axis around said terminal end of said lip of a stud when said stud is disposed in a generally perpendicular relationship with respect to said elongate member.

9. The wall construction track of claim 8 wherein said base wall of said elongate member further comprises at least one longitudinal protrusion to provide additional structural support to said elongate member.

10. The wall construction track of claim 8 wherein said at least one tab is defined by a vertical edge and a horizontal edge, said vertical edge extending downwardly from a terminal edge and said horizontal edge extending longitudinally from said vertical edge whereby said vertical and horizontal edges define said at least one tab with said side wall.

11. The wall construction track of claim 8 and further comprising a means for starting a fastener through one of said side walls of said elongate members and through a transverse wall of said stud.

12. The wall construction of claim 8 wherein:

said lip on each sidewall of said stud has a first face and a second face;

said at least one tab further comprises a first portion and a second portion;

whereby said first portion is adapted to be adjacent said first face and said second portion is adapted to be adjacent said second face.

13. The wall construction track of claim 8 wherein said at least one tab comprises a plurality of tabs spaced along each side wall of said elongate member at a regular interval.

14. The wall construction track of claim 13 wherein said regular interval is selected from the group consisting of: six inches, eight inches, sixteen inches and twenty-four inches.

15. A method of wall construction comprising:

providing a plurality of elongated studs, said studs each having a pair of opposed side walls, each of said side walls having an inwardly-directed lip thereon;

providing an elongate member having a base and first and second side walls extending perpendicularly from said base, said first and second side walls having at least one tab, said at least one tab bendable about an axis;

assembling a stud to the elongate member by placing one end of the wall stud into the channel of the elongate member so that the lips of said stud are disposed adjacent a rearward portion of said at least one tab;

confining the end of the wall stud in said elongate member by bending said at least one tab inwardly about said axis and around said lips of said stud.

16. The method of wall construction of claim 15 and further comprising the step of providing said base wall of said elongate member with at least one longitudinal protrusion to provide additional structural support to said elongate member.

17. The method of wall construction of claim 15 wherein said at least one tab is defined by a vertical edge and a horizontal edge, said vertical edge extending downwardly from a terminal edge of said side wall and said horizontal edge extending longitudinally from said vertical edge whereby said vertical and horizontal edges define said at least one tab with said terminal edge of said side wall.

18. The method of wall construction of claim 15 and further comprising the step of providing said elongate member with means for starting a fastener through one of said side walls of said elongate member and through a transverse wall of said stud.

19. The method of wall construction of claim 15 wherein:

said lip on each sidewall of said stud has a first face and a second face;

said at least one tab further comprises a first portion and a second portion;

whereby said first portion is adjacent said first face and said second portion is adjacent said second face when said tab is bend around said lip.

20. The method of wall construction of claim 15 wherein said at least one tab comprises a plurality of tabs spaced along each side wall of said elongate member at a regular interval.

21. The method of wall construction of claim 20 wherein said regular interval is selected from the group consisting of: six inches, eight inches, sixteen inches and twenty-four inches.

22. A wall construction track for receipt of an end of an elongated stud, the stud having a pair of opposed sidewalls, the sidewalls each having an inwardly-directed lip thereon, said wall construction track comprising:

an elongate member formed of bendable material having a base wall and first and second side walls extending perpendicularly from said base wall forming a channel;

said first and second side walls each having at least one tab, said at least one tab being bendable about an axis;

said at least one tab having a first portion and a second portion, said portions being of a sufficient length to be bent about said axis around said lips of a stud when said stud is disposed in a generally perpendicular relationship with respect to said elongate member, said first portion projecting inwardly from a respective first and second side wall, said second portion bent relative to said first portion.

* * * * *